United States Patent [19]

Leeds

[11] 4,103,130

[45] Jul. 25, 1978

[54] RESISTOR APPLICATIONS FOR HIGH-POWER CIRCUIT BREAKERS

[75] Inventor: Winthrop M. Leeds, Pittsburgh, Pa.

[73] Assignee: Westinghouse Electric Corp., Pittsburgh, Pa.

[21] Appl. No.: 544,992

[22] Filed: Jan. 29, 1975

[51] Int. Cl.[2] ..... H01H 33/70

[52] U.S. Cl. ..... 200/148 A; 200/145; 200/148 D; 200/144 AP; 200/148 B

[58] Field of Search ..... 200/148 D, 148 A, 145, 200/144 AP, 148 B

[56] References Cited

U.S. PATENT DOCUMENTS

| | | | |
|---|---|---|---|
| 2,748,226 | 5/1956 | MacNeill et al. | 200/148 D |
| 2,981,814 | 4/1961 | Friedrich | 200/148 D |
| 3,075,060 | 1/1963 | Strom | 200/148 D |
| 3,852,551 | 12/1974 | Cleaveland | 200/148 A |
| 3,899,650 | 8/1975 | Kishi et al. | 200/148 A |
| 3,914,569 | 10/1975 | McConnell et al. | 200/148 A |
| 3,941,962 | 3/1976 | Thaler | 200/148 A |
| 3,941,963 | 3/1976 | Sasaki et al. | 200/148 A |
| 3,975,602 | 8/1976 | Hertz et al. | 200/148 A |

*Primary Examiner*—Robert S. Macon
*Attorney, Agent, or Firm*—W. R. Crout

[57] ABSTRACT

A resistor assembly, together with a serially-connected resistor break, is connected in parallel, or shunting relationship, to an interrupting assembly, and arranged so that the resistor contacts remain closed while the main power-interrupting contacts open, and thereby divert the series line current through the resistor assemblage. This reduces the magnitude of the power-transmission line-current being interrupted, and lowers the rate of voltage rise across the main contacts so that arc reignition does not occur.

During the closing operation of the circuit-breaker, the mechanical operating arrangement is such that the resistor contacts close prior to the closing of the main power interrupting contacts, so that any voltage surges occurring during the electrical charging of the transmission line are adequately controlled.

In another embodiment of the present invention, a generally V-shaped interrupting assemblage is bridged by one or more resistor assemblages in a generally-horizontal fashion, the resistor assemblage having its own series-connected break, the latter being mechanically linked or connected to the operating-rod structure of the main power interrupting assemblage, constituting one of the upstanding leg portions of the V-shaped power interrupting assemblage. In a particular embodiment, each of the legs encloses its own main power break, and the resistor assemblage may include two series resistor breaks, if desired, together with one or more series resistor elements or assemblages.

21 Claims, 16 Drawing Figures

RESISTOR APPLICATIONS FOR HIGH-POWER CIRCUIT BREAKERS

CROSS-REFERENCES TO RELATED APPLICATIONS

One of several patent applications which have been filed relating to the generally V-shaped interrupting assemblage is that set forth in U.S. patent application filed Dec. 30, 1968, Ser. No. 787,658, now U.S. Pat. 3,665,133 issued May 23, 1972 to Frank L. Reese and Hayes O. Dakin, Jr., entitled "Delayed-Acting Blast-Valve Operator Construction", and assigned to the assignee of the instant patent application. Other patent applications, referred to therein, have been filed relating to detailed structural component portions of the aforesaid interrupting assemblage.

BACKGROUND OF THE INVENTION

When circuit-breakers are called upon to interrupt high voltages and high power, and to prevent voltage surges being imposed upon the connected electrical system, it is occasionally desirable to employ a shunting resistor. U.S. Pat. No. 2,911,546, issued Nov. 3, 1959 to J. A. Oppel, illustrates a general type of shunting resistor application. See also, additionally, U.S. Pat. No. 3,114,816, issued Dec. 17, 1963 to John W. Beatty, and U.S. Pat. No. 3,482,069, issued Dec. 2, 1969 to Badey et al.

It is well known by those skilled in the art that the use of a shunting resistor damps the recovery-voltage transient during the opening stroke of the circuit-breaker. See, for example, U.S. Pat. No. 3,390,329, issued June 25, 1968 to R. H. Miller. This has the advantage of rendering the electrical circuit easier to interrupt; however, due to the additional complication of a resistor assemblage and its own individual series resistor break, generally, the overall time of interruption of the circuit-breaker is lengthened. U.S. Pat. No. 3,267,241—Wilson, however, illustrates for example, a high-voltage, high-power compressed-gas circuit-breaker, which the manufacturer claims is capable of two-cycle interruption. In this particular circuit-breaker, a resistor is employed in shunting relationship with the main power break. During the closing operation, the resistor circuit is closed prior to the closing of the main power contacts. See also U.S. Pat. No. 3,211,868, issued Oct. 12, 1965 to Barkan et al.

SUMMARY OF THE INVENTION

The use of opening resistors electrically paralleling the main power breaks may be used as a means of raising the interrupting rating capability of circuit-breakers, such as of the compressed-gas type, by controlling the rate of rise of the recovery-voltage transient. Such an arrangement increases the interrupting power capability of the circuit-interrupter, and not only lowers the rate of rise of the recovery-voltage transient, rendering the electrical circuit thereby easier to interrupt, but, additionally, during the closing stroke of the circuit-breaker, the insertion of one or more resistors assists in damping voltage surges produced when energizing the connected power transmission line.

In accordance with one aspect of the present invention, a dual-pressure high-voltage compressed-gas circuit-interrupter of a generally V-shape is bridged across its upper ends by a resistor assemblage, comprising at least one resistor element in series with a resistor break, the latter opening after the opening of the main power contacts. During the closing operation, the arrangement is such that the resistor contacts close first, thereby closing the electrical circuit through the resistor element, and subsequently the main power break contacts close so as to short out the resistor assemblage at the end of such a closing operation of the circuit-breaker.

In accordance with another aspect of the present invention, a mechanical linkage system ties together the mechanical operator for the high-voltage compressed-gas circuit-interrupter with the mechanical operation of the associated resistor-contact assemblage.

According to a further aspect of the present invention, a highly-effective gas, such as sulfur-hexafluoride ($SF_6$) gas, is used in a sealed "puffer-type" circuit-interrupter unit, taken in close association with the main power interrupting assemblage, and, preferably, the two being mechanically linked and operated together by a suitable mechanically-connecting operating linkage system.

According to a further aspect of the present invention, a resistor assemblage, including one or more resistor elements and serially-related resistor contacts, electrically bridge two upstanding power-interrupting assemblages, the construction operating to delay the opening of the resistor contacts, until the opening of the power-interrupting contacts. Thus, the resistance is inserted toward the end of the opening operation of the circuit-breaker, and, on the closing operation, correspondingly, the resistance is inserted during the initial portion of such closing operation, and subsequently shorted out by the main power interrupting contacts in the fully-closed-circuit position of the circuit-interrupter.

Still a further aspect of the present invention contemplates the provision of a resistor assemblage, comprising one or more resistor elements and serially-related separable resistance contacts, disposed in electrically-shunting relationship across the separable power interrupting contacts of a single power-interrupting assemblage.

DESCRIPTION OF THE PREFERRED EMBODIMENTS

Figure 1:
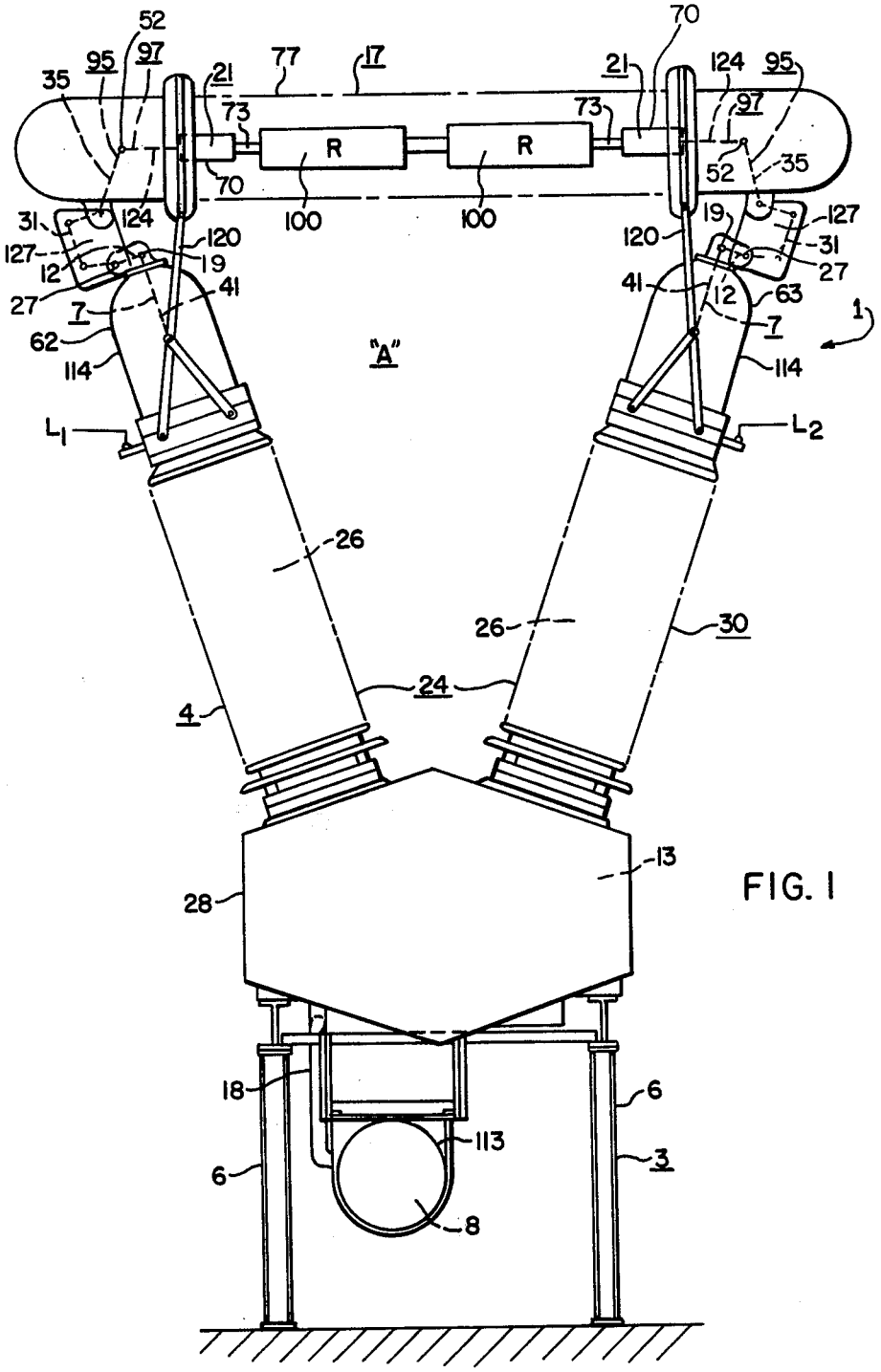
FIG. 1 is a side-elevational view of a single pole-unit of a three-phase high-voltage high-power dual-pressure circuit-interrupter assemblage, illustrating an application of the present invention, the contact structure being shown in the closed-circuit position.

FIG. 1, generally, shows a single pole-unit "A" of a high-voltage, high-power, dual-pressure circuit-interrupter 1 incorporating the principles of the present invention, and illustrated in the closed-circuit position. It will be noted that the circuit-breaker structure 1 is supported by a metallic framework 3, which may be composed of heavy angle-iron braces and steel struts 6. The circuit-breaker structure 1 is generally of the dual-pressure gas type involving the use of a suitable arc-extinguishing gas 8 at two different pressures, namely a high-pressure, say 230 p.s.i.g. suitable for use for injecting into the arc 11 (FIG. 4) to effect the extinction thereof. In addition, the high-pressure gas 8 is used in the operating mechanism 7 (FIG. 3A) to effect actuation of the piston structure 10 associated therewith. Low pressure gas, say 60 p.s.i., is used on the exhaust side of pistons and blast valves and for insulating purposes within parts of the circuit breaker.

Generally, there are three pole-units A, B and C spaced laterally apart upon the grounded supporting framework 3, and the operating mechanism gas-valves are mechanically interconnected to a common mechanism 13 (FIG. 1) at ground potential.

Figure 2A:
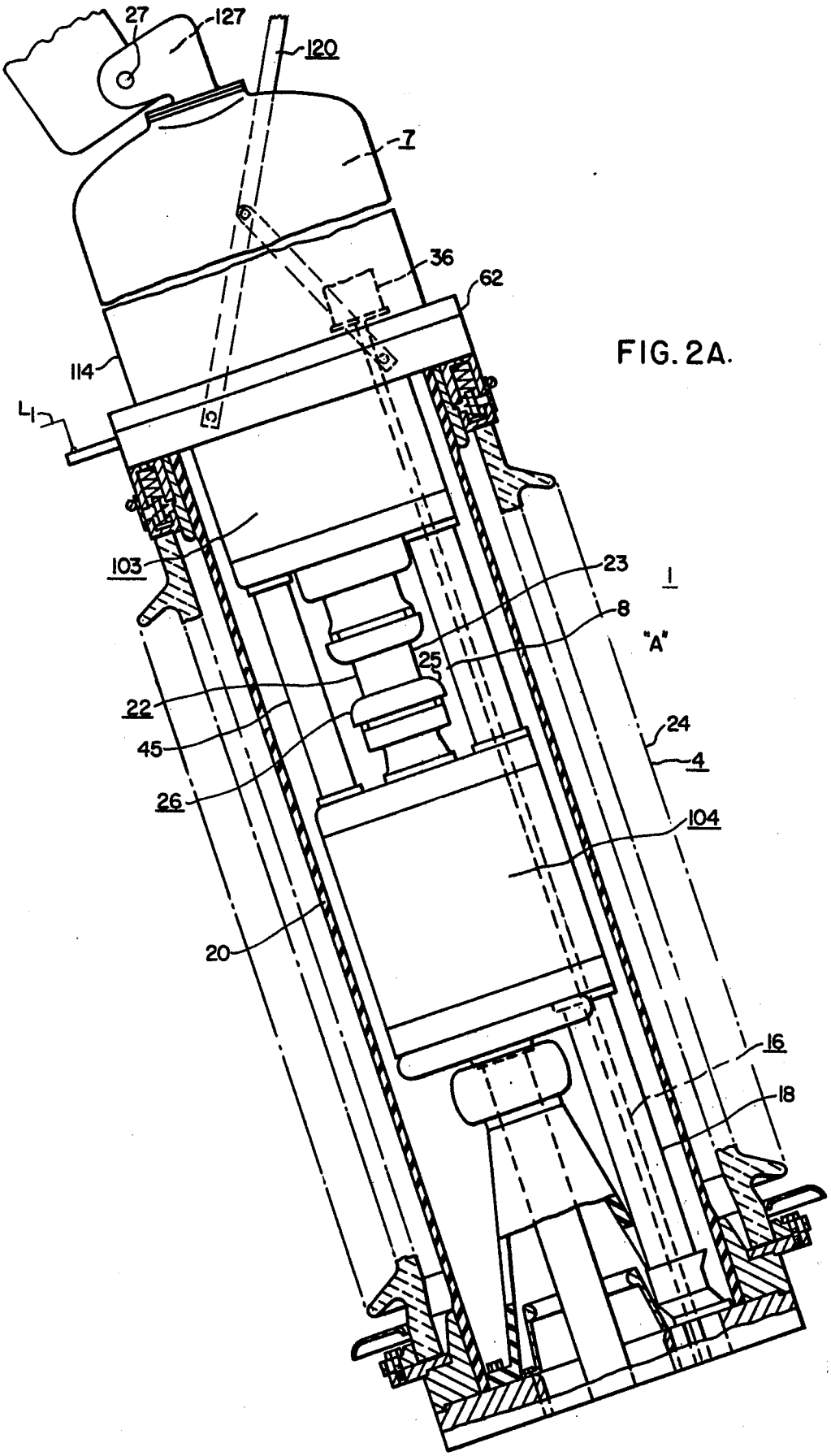
FIGS. 2A - 2C illustrate, collectively and to an enlarged scale, a vertical sectional view taken fragmentarily through the main power circuit-interrupting assemblage, the separable contact structure being illustrated in the closed-circuit position.
Figure 10:
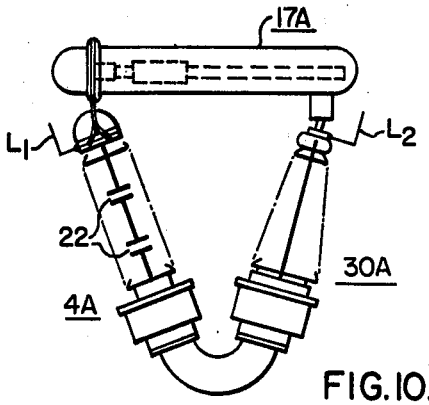
FIG. 10 illustrates another modified type of interrupter and the situation where the right-hand column assemblage again is merely a terminal-bushing structure with no breaks, and two power-interrupting breaks are utilized in the left-hand arc-extinguishing assemblage for accommodating a higher voltage rating.
Figure 11:
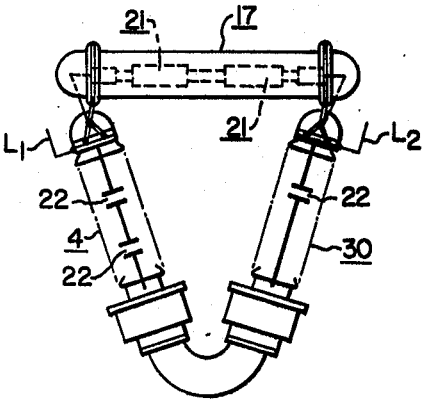
FIG. 11 diagrammatically illustrates another still different embodiment of the invention, in which there is only a single power-break utilized in the right-hand column assemblage, whereas two interrupting breaks are utilized in the left-hand power-interrupting assemblage for still higher voltage ratings.
Figure 9:
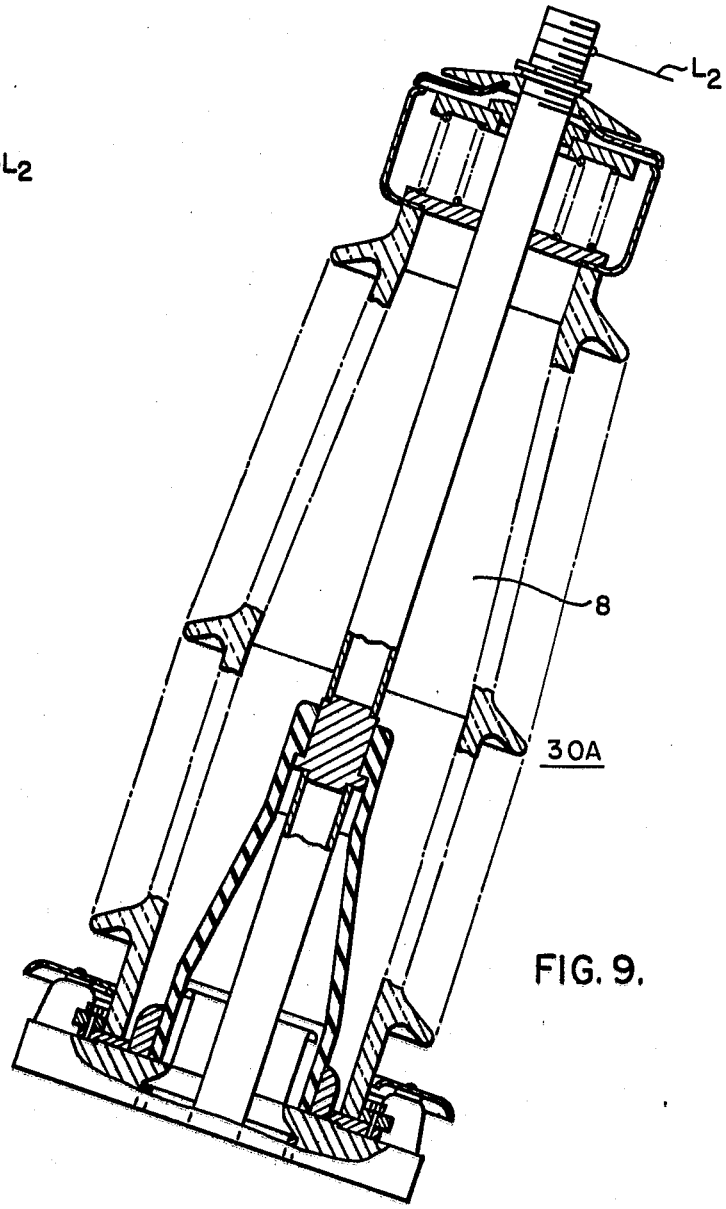
FIG. 9 is an enlarged vertical sectional view taken through the right-hand column structure of FIG. 8 illustrating that, instead of utilizing interrupting breaks for such a lower-rating circuit-breaker application as illustrated in FIG. 8, a terminal-bushing structure only need be utilized.

Briefly, the manner of opration of the circuit-breaker structure 1 is such as to cause the actuation of the ground potential operator 13 (FIG. 1) to effect motion of a mechanical linkage 14 (FIG. 2B), which interconnects the several three-way valve-control rods 16 extending upwardly individually within the three arc-extinguishing assemblages 26. As illustrated diagrammatically in FIG. 3A of the drawings, the valve-control rod 16, moving only a short distance, extends upwardly within an insulating supporting tube 18 (FIG. 4) disposed interiorly of an insulating inner tension tube 20 serving to spatially space the one or more pairs of power contact structures 22 which may be employed. As shown in FIG. 2A, only a single pair of separable power contact structures 22 is utilized; however, for the higher voltages and higher ratings, as shown in FIGS. 10 and 11, a plurality of pairs of power contact structures 22 may be utilized, if desired.

Generally, the arc-extinguishing assemblage 4 comprises an outer insulating weather-proof casing 24, which may be formed either of porcelain, or of a suitable resinous material serving to enclose the power arc-extinguishing structure 26 of the interrupter 4. The arc-extinguishing structure, or assemblage 4 is supported upon the grounded housing 28 and is slanted, or canted away from an identical structure 30, which serves to cause the current path to be conducted in a generally V-shaped path through the circuit-breaker 1.

Figure 2B:
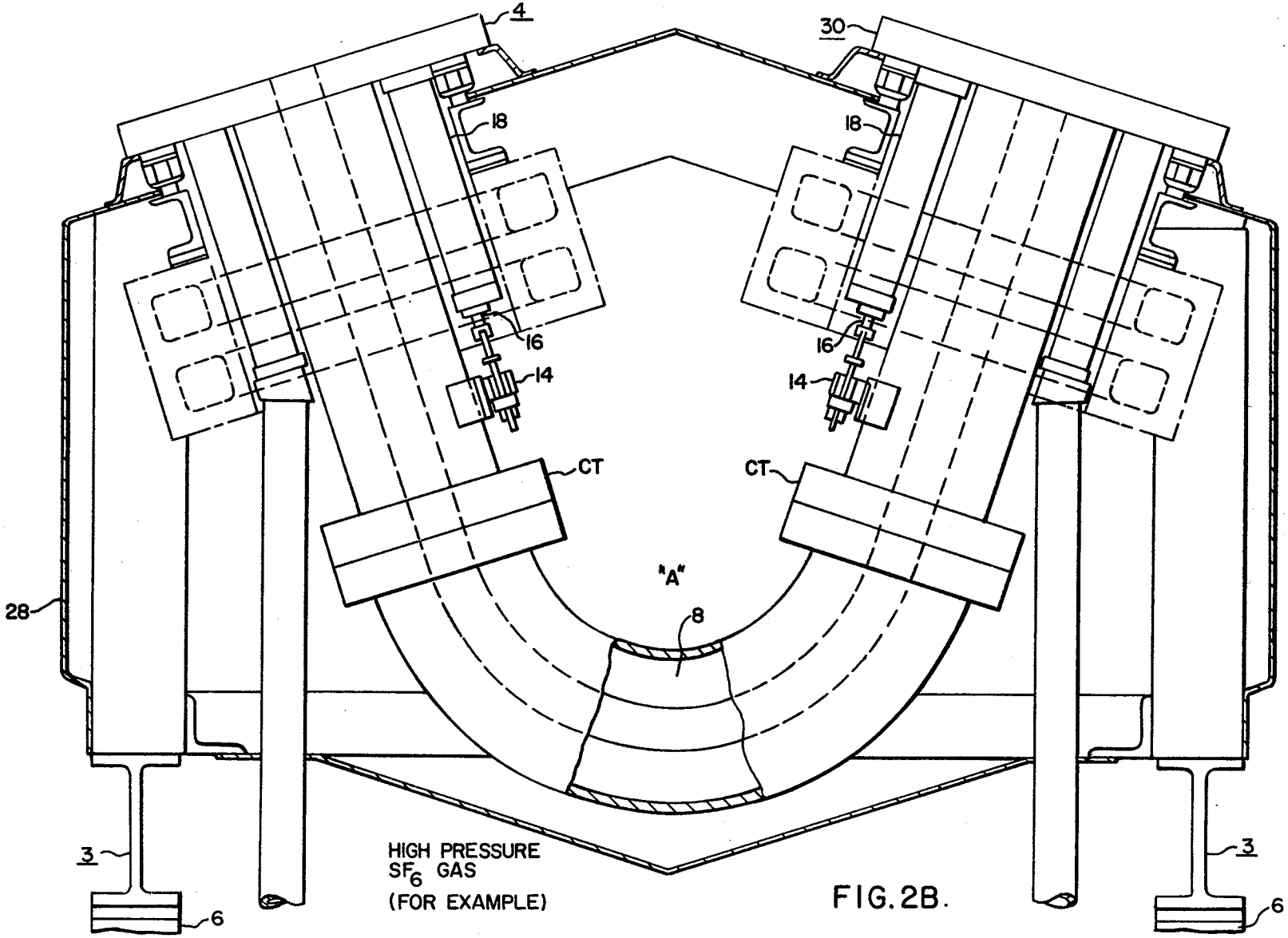
Figure 2C:
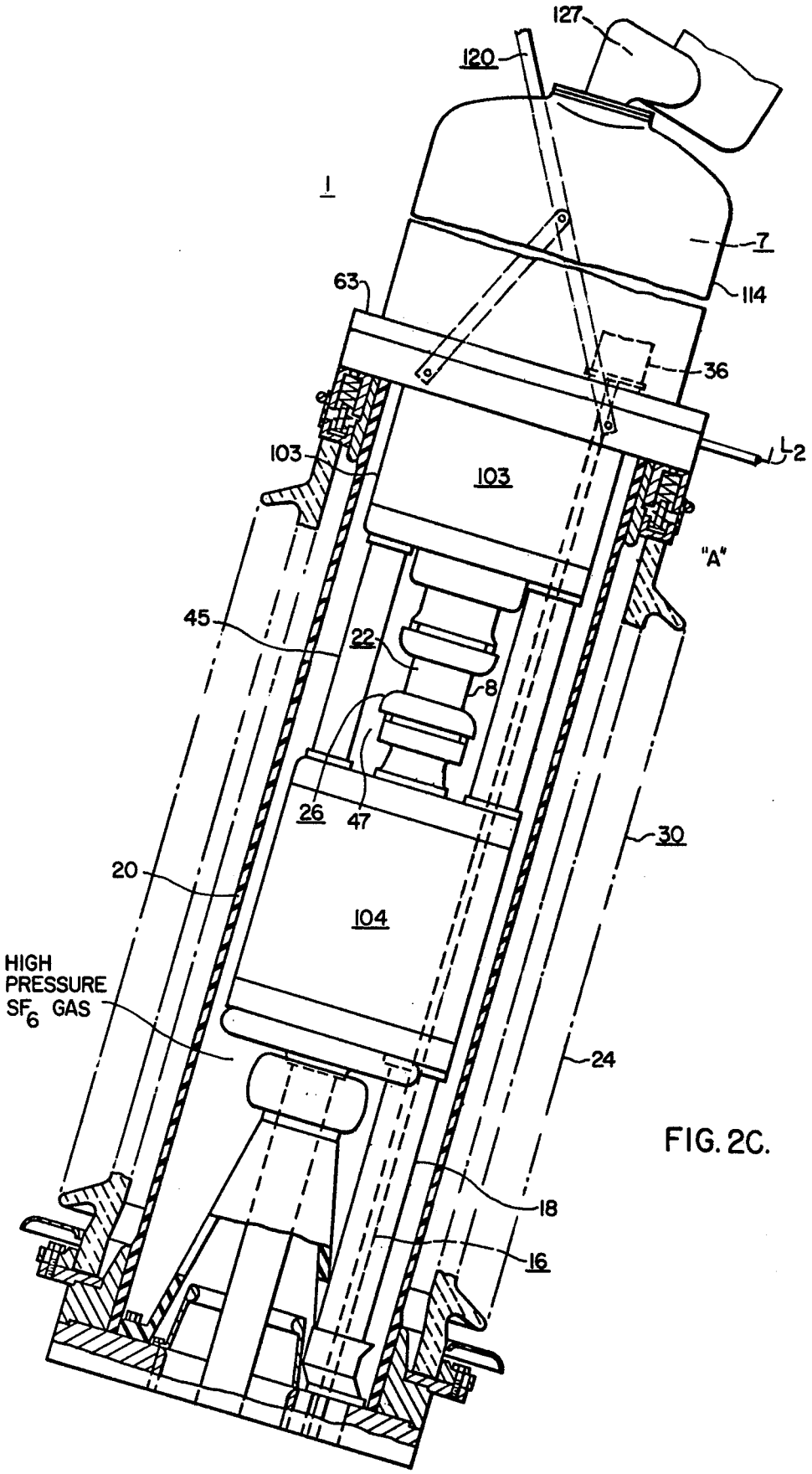

FIGS. 2A–2C collectively show a vertical cross-sectional view taken through the single pole-unit "A" of the three-phase circuit-interrupter 1. As well known by those skilled in the art, there are three such structures "A", "B" and "C" to control the three phases of a three-phase transmission system.

In the circuit-breaker structure 1 under consideration, a suitable highly-effective arc-extinguishing gas 8, such as sulfur-hexafluoride ($SF_6$) gas, for example, may be used as the arc-extinguishing gas, and also as an insulating gas to enable a close spacing of the live metallic parts. U.S. Pat. No. 2,757,261 describes the desirable arc-extinguishing characteristics of this particular $SF_6$ gas 8.

As mentioned hereinbefore, generally, the manner of operation of the circuit-interrupter 1 is the simultaneous actuation of the three valve-control tripping rods 16, which extend upwardly into the tops of the arc-extinguishing assemblages 4, 30. Here, as is shown more clearly in FIG. 3A of the drawings, the upper ends of the valve-control tripping rods 16 are biased upwardly by a battery of compression springs 32, seating upon a spring-seat 33 affixed to the valve-control rod 16, as at 34, and serving to bias the pressure-balanced three-way control-valve 36 to its upper closed position. To effect an opening operation of the circuit-breaker 1, the valve-control rod 16 is moved upwardly, say three-quarters of an inch, so as to permit the admission of high-pressure gas 8, existing within the region 37, upwardly through a conduit 39, and across the entire lower surface of a dual-acting piston structure 10, which is connected, by means of a piston-rod 41, to the movable power contact structure 23 of the interrupter 1.

Figure 3A:
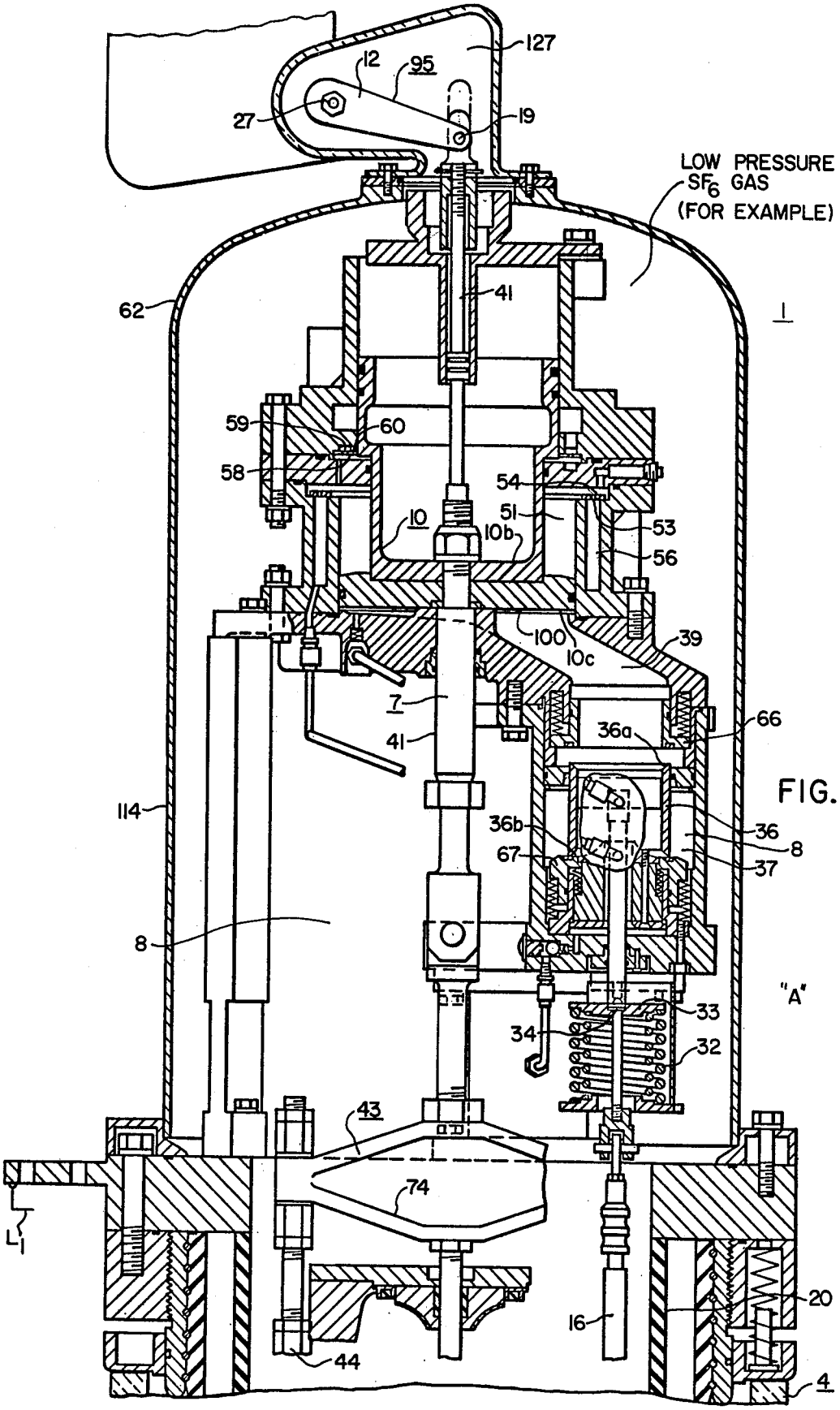
FIGS. 3A and 3B, collectively, illustrate a vertical sectional view taken through the left-hand power-interrupting assemblage of FIG. 1, the contact structure being illustrated in the closed-circuit position.
Figure 3B:
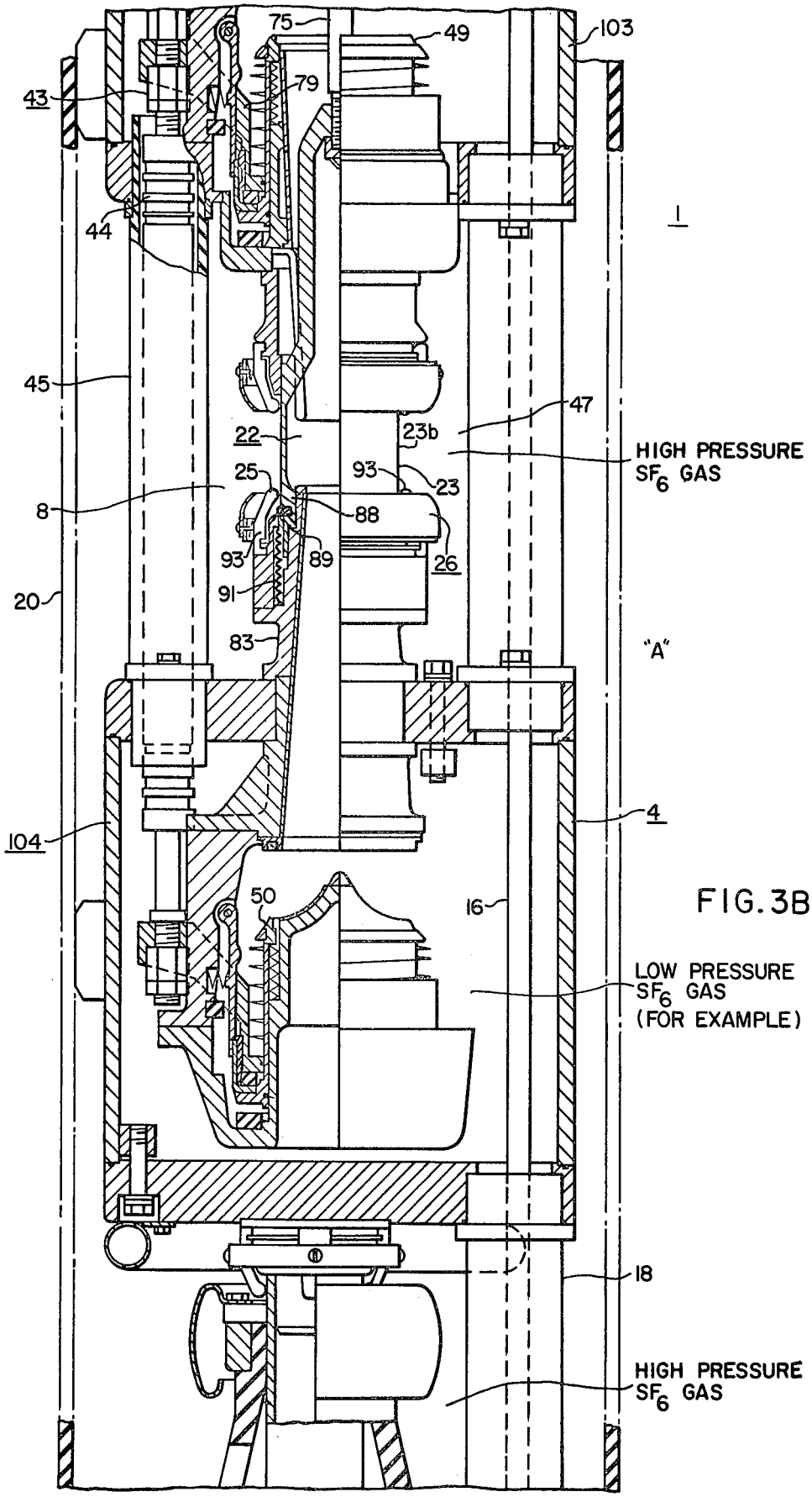

As shown more clearly in FIG. 3A, taken in conjunction with FIG. 3B, it will be observed that the piston structure 10 is mechanically connected, by means of the piston-rod 41, to a generally ladder-shaped structure 43, which comprises a pair of laterally-spaced insulating operating rods 44, which extend axially of the arc-extinguishing assemblage 4 and through a pair of hollow insulating supporting tubes 45.

The region 47, immediately adjacent the power contact structure 22, and externally thereof in the closed-circuit position thereof, as illustrated in FIG. 3B, is at a relatively high pressure, say 230 p.s.i., for example, as more clearly described in U.S. Pat. No. 3,686,454, issued Aug. 22, 1972, to Lee E. Berkebile, the arc-extinguishing structure, or unit 26, being of the so-called "downstream" type, in which the high-pressure gas 8 moves into and through the separated power contact structure 22, during the opening operation, until the flow of gas 8 is halted by the closing operation of a pair of "downstream", or "secondary" blast-valves, indicated by the reference numerals 49 and 50 in FIG. 3B of the drawings.

With reference to FIG. 3A of the drawings, it will be observed that the dual-acting piston structure 10 has a differential annular area $10_x$ equal to the difference of area 10*a*–10*d*, herein termed the effective closing area portion of the piston 10. This effective closing area 10*x* is constantly subjected to a high-pressure gas within the region 51. In addition, the piston structure 10 has the upper closing face portion 10*b* thereof constantly subjected to gas at a relatively low pressure, say 60 p.s.i., for example, which tends to effect the closing operation of the piston 10, and hence the movable power contact structure 23. The annular area, which is effective in opening the mechanism, is 10*c*–10*x*. The area, that is effective in closing the contact structure, is 10*a*–10*d*, or 10*x*.

To effect an opening operation of the circuit-interrupter 1, actuation of the three-way control valve 36 is brought about by upward movement of the valve-control tripping rod 16 to admit high-pressure gas upon the lower face 10*c* of the piston structure 10, causing thereby opening upward motion of the contact structure 22, and, additionally, trapping high-pressure gas within the space 51, for shock-absorbing action, and causing its slow leakage through the ports 53 provided in the annular check-valve 54. During the closing operation, upon downward movement of the piston structure 10, the check-valve 54, associated with this shock-absorber, raises, and permits high-pressure gas, which is constantly present within the region 56, to flow past the ring-shaped check-valve 54 and into the shock-absorbing region 51.

During the closing operation, the downward movement of the piston structure 10 effects the downward movement of a stepped portion thereof into the space 58, which contains gas at relatively high pressure. This performs a shock-absorbing function during the closing stroke, the gas 8 leaking through perforations 59 provided in a ring-shaped check-valve 60.

The three-way valve structure 36 comprises movable valve seats 66, 67, which take care of any misalignment or elongation or contraction of the valve-control rods 16, which may be of considerable length. In addition, the valve seats 66, 67 are spring-biased in a direction to effect following travel, once the lips 36*a*, 36*b* of the valve 36 has separated therefrom.

MOVABLE POWER CONTACT STRUCTURE (23)

As briefly pointed out hereinbefore, the movable power contact structure 23 comprises a generally H-shaped movable contact assemblage 43 secured at its upper end to a yoke-shaped structure 74 (FIG. 3A), which, in turn, is mechanically adjustably secured to the lower end of the piston-rod 41. A pair of spaced insulating side operating rods 44, constituting a portion of said H-shaped structure 43, extend interiorly of hollow insulating supporting tubes 45, serving to space the interrupting units 26 axially or vertically apart when two series units 26 are involved.

Figure 4:
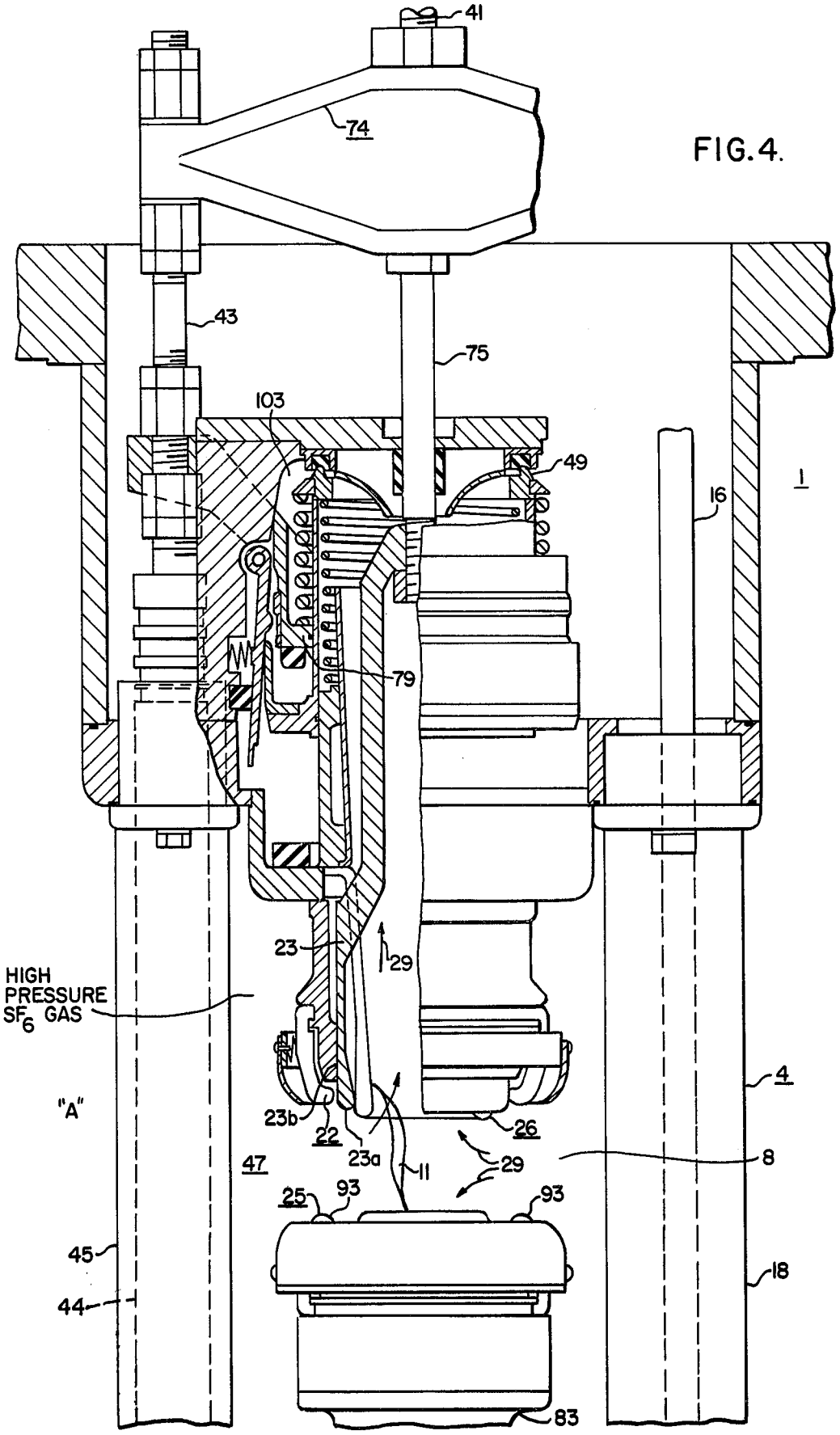
FIG. 4 is a fragmentary, enlarged, vertical sectional view taken through the power-interrupting break of FIG. 3B, with the power contacts illustrated in the open-circuit position, and the arc position being illustrated, together with the gas-flow conditions encountered during an opening operation of the interrupter of FIGS. 3A and 3B.

With reference being directed particularly to FIG. 4 of the drawings, it will be observed that the yoke structure 74 has a downwardly-extending stem portion 75, which is adjustably secured to the hollow movable power contact 23. The side operating rods 43, additionally, are secured to a movable blast-valve activator 79.

The moving power contact 23 makes separable engagement with a movable hollow seal structure 89 (FIG. 3B), which is supported by a stationary hollow contact structure 83, which is fixably supported upwardly from a base support plate-part 104. As shown in more detail in FIG. 4 of the drawings, an exhausting flow of arc-extinguishing fluid 8 at high-pressure occurs across the arc 11, and diametrically in opposite directions venting through the interior of both the movable and stationary hollow power contacts 23, 25, as indicated by the arrows 29 in FIG. 4.

Generally, there is provided a primary blast-valve 88 (FIG. 3B) constituted by the lower tip portion 23*a* of the movable power contact 23 making abutting engagement with the relatively stationary primary blast-valve seat 89 (FIG. 3B) resiliently supported upon the stationary contact support 83, as shown in FIG. 3B. A compression spring 91 provides a desired contact pressure therebetween, and also provides for a limited amount of overtravel of the movable power contact 23. Additionally, there is provided a plurality of circumferentially-disposed stationary contact fingers 93, which make contacting engagement with the external side 23*b* of the movable tubular power contact 23.

In addition to the primary blast-valve support, there is provided a pair of secondary downstream blast-valves 49, 50, (FIG. 3B), which are closed near the end of the opening operation of the circuit-breaker, as described more clearly hereinafter.

The circuit-interrupter 1 of the present invention provides a novel means for operating the secondary blast-valves 49, 50. In the circuit-breaker of the present invention, as previously pointed out, a gas-operated mechanism 7 is used to open and close the power contacts 23 of the interrupter 1.

The movable power contact 23 of the circuit-interrupter forms a seal with the relatively stationary primary blast-valve seat 89 (FIG. 3B), constituting a primary blast-valve 88, so that when the circuit-breaker contacts 23, 25 are closed, the seal 88 at the primary blast-valve prevents the high-pressure gas 8 from flowing into the center of one or both of the hollow moving separable power contacts 23, 25. At this time, the secondary blast-valves 49, 50 are open. When the moving power contact 23 opens during the opening operation, the secondary blast-valves 49, 50 are going closed to stop the exhausting gas flow 8 into the low-pressure exhaust chambers 103, 104 following arc extinction.

The pneumatic mechanism 7 disposed within the cap structure 114 and concerning the dual action of the piston 10, is set forth and claimed in U.S. Pat. No. 3,639,713, issued Feb. 1, 1972, to William H. Fischer and Wayne S. Aspey, and assigned to the assignee of the present invention.

The exhausting gas flow during the opening operation is collected in the low-pressure exhaust chambers 103, 104, and eventually is conducted by means of the hollow tubes 18 down to the low-pressure tank 113 at the base 3 of the supporting framework, as clearly illustrated in FIG. 1 of the drawings. A suitable compressor, not shown, is used to recompress the gas 8 to the high-pressure level of 230 p.s.i., for example.

The present invention is particularly concerned with the association with the main circuit-breaker 1, the operating description of which has been described heretofore, of a shunting resistor assemblage 17, bridging the upper ends 62, 63 (FIG. 1) of the legs 4, 30 of the main circuit-interrupter 1, as illustrated in FIG. 1.

Figure 5:
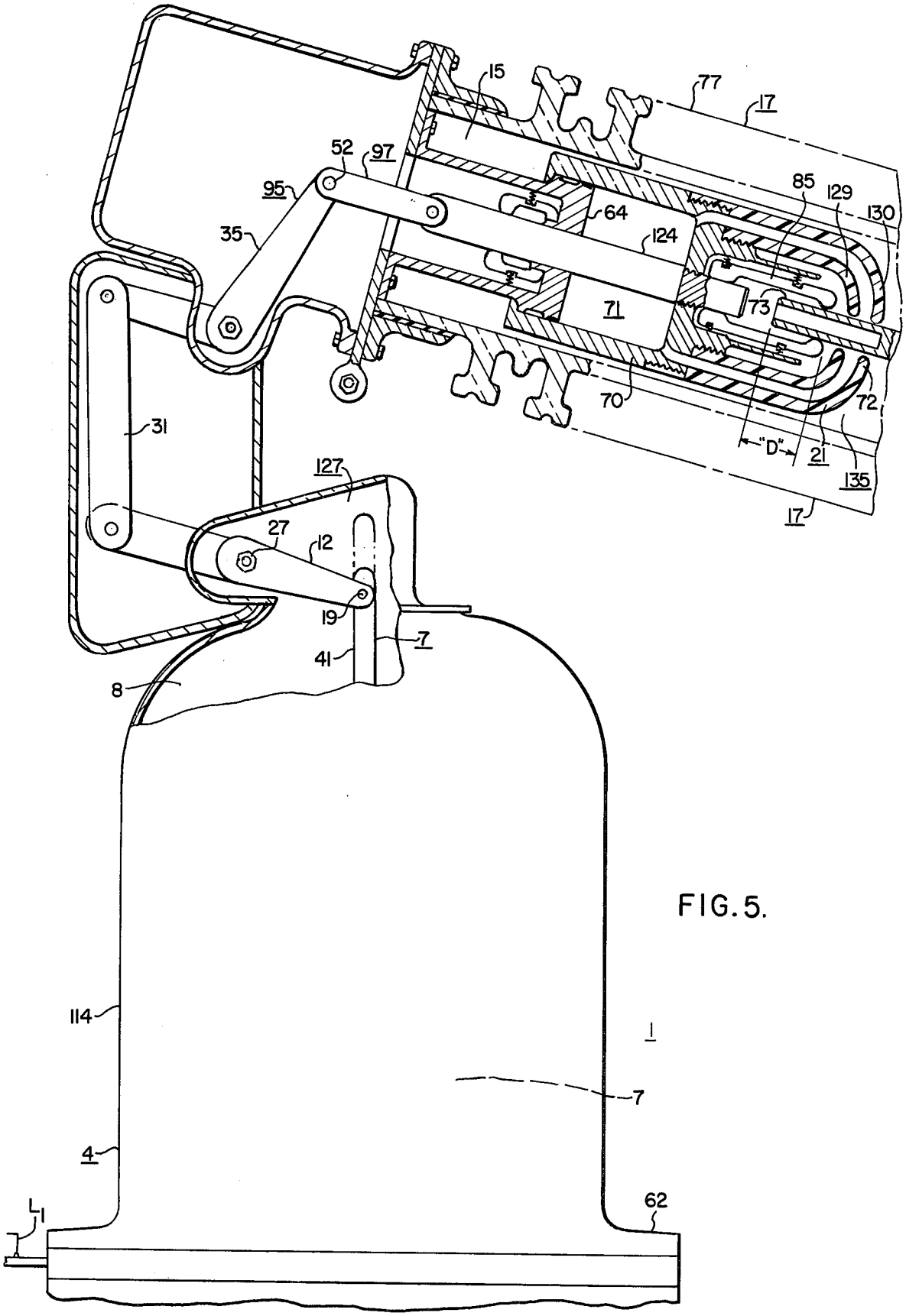
FIG. 5 is a fragmentary view illustrating the upper portion of the power-interrupting assemblage of FIG. 1, together with a portion of the resistor interrupting assemblage, the resistor contact structure of FIG. 1 being illustrated in the closed-circuit position.
Figure 6:
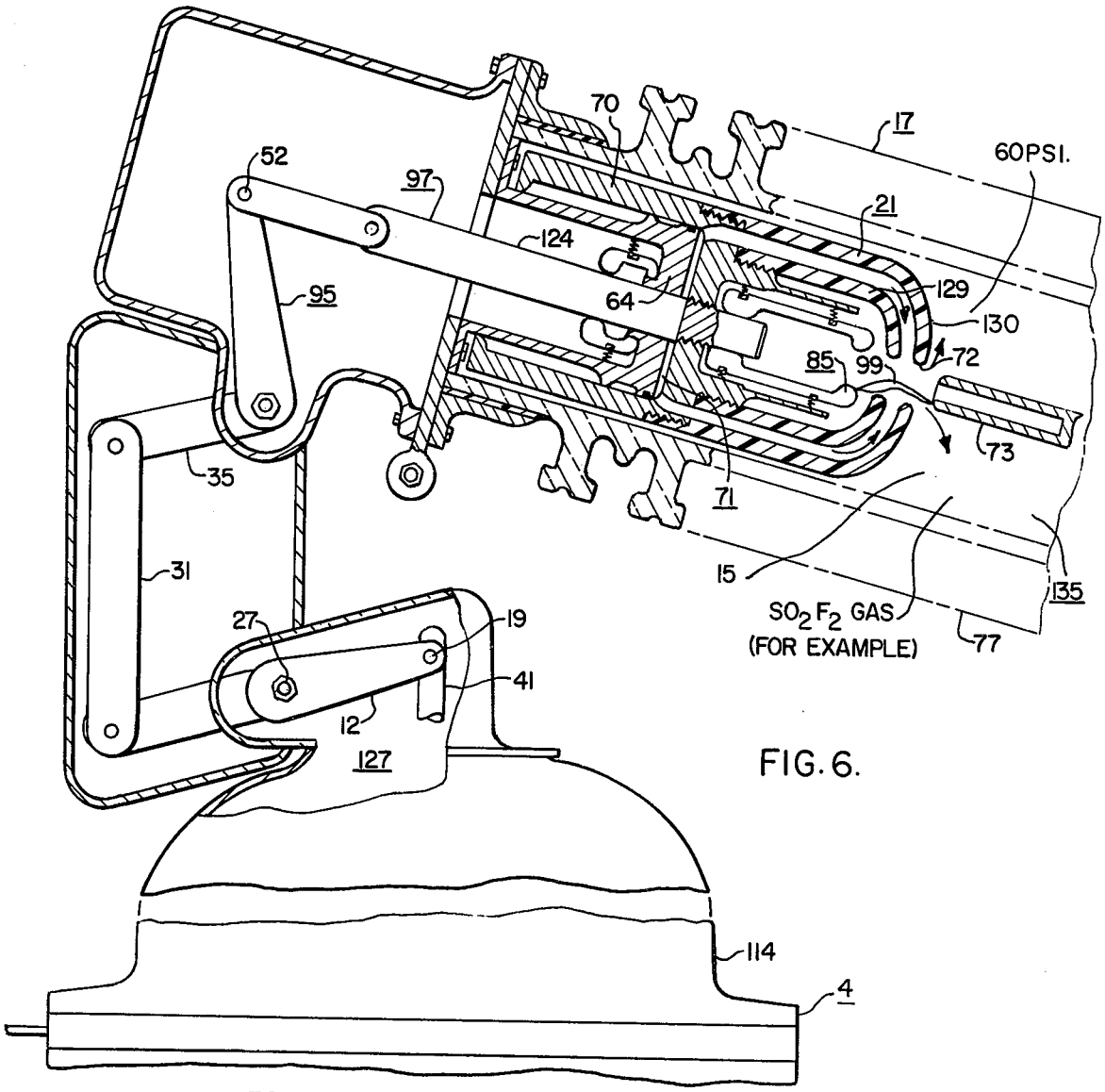
FIG. 6 is a view somewhat similar to that of FIG. 5, but illustrating the disposition of the several interrupter parts in the fully open-circuit position of the circuit-interrupter of FIG. 1, with the movable resistor contact withdrawn to its fully open-circuit position, the arc being indicated for purposes of clarity.
Figure 7:
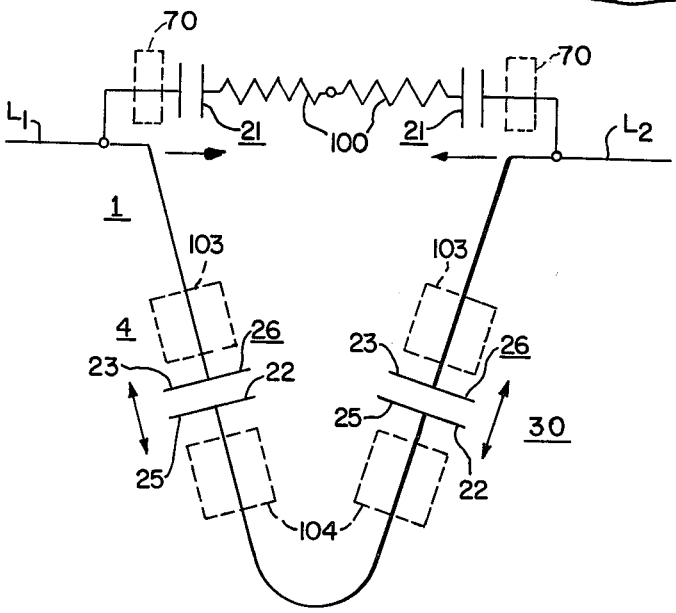
FIG. 7 is a diagrammatic view illustrating the resistor connections across the main power-interrupting breaks of FIG. 1, with the arrows indicating the gas-flow conditions.
Figure 8:
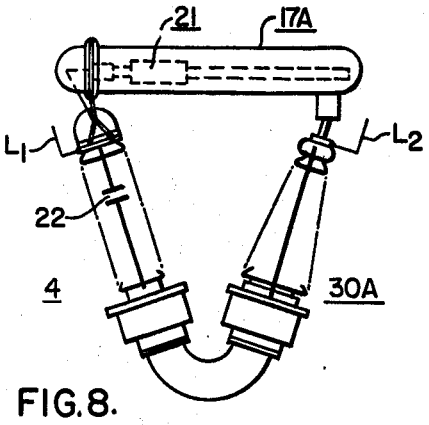
FIG. 8 diagrammatically represents a modified form of the invention and the situation involved in the lower-rated circuit-breakers, in which only a single power-interrupting break need be utilized, the right-hand assemblage merely being a terminal-bushing structure, so that for the entire modified type of power interrupting assemblage, there will be only one power-interrupting break utilized, together with the shunting resistance assemblage, the right-hand column structure merely being, as mentioned, a terminal-bushing structure with no interrupting break involved therewith.

It will be noted that the shunting resistor assemblage 17 comprises a pair of serially-connected "puffer-type" interrupting units 21 (FIG. 1), each of which is mechanically linked, and operated by, the upstanding operator 7 disposed in the upper cap portion 114 of each of the interrupting structures 4, 30 of the circuit-breaker 1. As shown more clearly in FIGS. 3A, 5 and 6, the upper operating rod 41 in each assemblage 4, 30 is pivotally connected, as at 19, to a crank-arm 12, the latter extending out through a rotating shaft-seal 27, and externally linked by a floating link 31, to a similar crank-arm 35, which connects at 52 to an interior reciprocally-movable cylindrical "puffer-type" operating cylinder 70. The cylindrically-movable puffer cylinder 70 slides over a relatively fixed piston 64 (FIG. 5), thereby compressing gas (which may be a different arc-extinguishing gas 15 from the gas 8 in the power interrupter 26 and at a different pressure, say 75 p.s.i.) within the region 71 within the resistor interrupting unit 21. Due to the blockage within the orifice 72 of the relatively stationary tubular resistor contact 73 within the annular outlet of the puffer-type unit 21, there is a delayed gas-blast, occurring only after the orifice opening 72 has been "unplugged" by the withdrawal of the movable cylindrical puffer cylinder 70 over the stationary tubular contact 73 to a location, as illustrated in FIG. 6 of the drawings. As shown in FIG. 6, a release of the gas blast 15 permits the resistor arc 99 to be extinguished by a gas flow out through the orifice 72 of the puffer unit 21.

The entire puffer unit 21 is disposed, generally, within the end extremities of a cylindrical insulating outer casing 77, preferably made of porcelain, and having an external corrugated configuration, as more clearly described in U.S. Pat. No. 3,281,525, issued Oct. 25, 1966 to Sonnenberg et al.

From the foregoing description of the actuating linkage 95, it will be apparent that there is a desirable mechanical "tie" between the mechanical operator 7 of the main power circuit-breaker assemblage 1 and the mechanical operator 97 for the puffer-type resistor unit 21. The resistor assemblages 21 themselves are preferably disposed adjacent the central portion of the horizontally-extending insulating casing 77, and provide a desired voltage damping of the circuit $L_1$, $L_2$ during the opening operation of the circuit-breaker.

The arrangement is such that during the opening operation, the resistor contacts 73, 85 remain closed because of the long overlap at "D", so that this gives the main power contacts 23, 25 a chance to open, and to divert the current through the separable resistor contacts 73, 85. When the main power arcs 11 (FIG. 4) are extinguished within the main legs 4, 30 of the interrupter 1, at this time the gas blast 15 is released within the puffer interrupting units 21, and the resistor arcs 99 (FIG. 6) are quickly extinguished, thereby interrupting the entire power transmission circuit $L_1$, $L_2$.

During the closing operation, the arrangement is such as to mechanically effect a closing of the resistor contacts 73, 85 prior to a subsequent closing of the main power contacts 23, 25 within the main legs 4, 30 of the circuit-interrupting assemblage 1.

The present invention utilizes the use of opening resistors 100, paralleling the main power breaks 23, 25, as a convenient method for raising the interrupting rating of the particular circuit-breaker 1, described in the aforesaid application, by controlling the rate of rise of the recovery voltage transient. The present invention shows how the resistors 100 may be mounted across the top of the V-shaped circuit-interrupter assemblage 1. As shown in FIG. 1, the top of the V-shaped circuit-breaker 1 supports the supporting brackets 120, which, in turn, support the resistor assembly 17 containing two resistor elements 100 and two puffer-type $SF_6$ resistor current-interrupters 21. The operating linkage 97 is arranged to connect each of the puffer operating rods 124 to the main operator 7 at the top of each leg 4, 30 of the main circuit-breaker 1. This operating linkage 97 operates through the rotating shaft gas-seals 27 of the type used in other $SF_6$ gas circuit-breakers to avoid leakage of $SF_6$ gas 8 from the interior of the sealed gas chambers 127 to the atmosphere.

In the use of resistors 100, paralleling a main power interrupter 26, it is desirable to delay the opening of the resistor current-interrupting contacts 73, 85 until after the main power contacts 23, 25 have had time to open, and to divert the current through the resistors 100. In the present invention, the ratio of the arms 12, 35 of the puffer operating linkage 95 is proportioned so that the puffer contacts 73, 85 move through, say a 6-inch stroke, for example, while the main power breaker operating mechanism 7 moves through only a 3-inch stroke, for example.

The puffer contacts 73, 85 are arranged with a long lap "D" of approximately 2 inches to delay their parting time until after the main power contacts 23, 25 of the $SF_6$ breaker 23, 25 have parted. During this time, the moving operating cylinder 70 is compressing $SF_6$ or other suitable arc-extinguishing gas 15, such as $SO_2F_2$, as the volume 71 between the end of the cylinder 70 and the fixed piston 64 is reduced. The hollow fixed contact 73 blocks the exit 72 between insulating flow-guides, which direct the pressurized $SF_6$, or other gas 15, from the cylinders 70, until after the moving assemblage 124, carrying the fingers 85 and flow guides 129, 130, has "peeled off" of the central stationary resistor contact 73. The gas 15 then blasts into and extinguishes the arc 99 drawn between the separating resistor contacts 73, 85.

Conventional air-blast breakers, which utilize opening resistors, must provide separate piping to direct an interrupting gas blast into the separate resistor current interrupter, with the resulting additional complication and expense. Only with a considerably more effective interrupting gaseous medium than compressed air, such as $SF_6$, $SO_2F_2$, $H_2$ or gas mixtures, for example, 50% $N_2$ with 50% $SF_6$, can the novel arrangement here disclosed with a mechanically-interconnected puffer resistor current-interrupter 21, in a separate sealed gas chamber 135, be utilized.

It should be particularly noted that the mechanical linkage 95, which separates the resistor current interrupting contacts 73, 85 after the main power contacts 23, 25 open, will automatically on the closing stroke close ahead of the main power contacts 23, 25. This inserts the resistors 100 first, with the resulting benefit of transmission line energizing switching-surge suppression, followed after a very short interval of time by closing of the main power contacts 23, 25, which then, of course, short out the resistors 100 before they have time to overheat.

Special features of the preferred embodiment include a mechanical linkage connecting the puffer operating rod 124 with the main break operator 7; delayed parting of the puffer contacts 73, 85 on opening, until after the main power contacts 23, 25 have parted to allow time for the current to be diverted into the resistor 100; delayed exhaust of the compressed gas 15 in the puffer cylinder 70 until after the contact movement uncovers ports 72 in the insulating gas-flow guides 129, 130; insertion of the resistor 100 on the closing operation of the circuit interrupter to suppress voltage surges followed by closing of the main contacts 23, 25 of each interrupter 26 of FIG. 1 to thereby short out the resistors 100.

Figure 12:
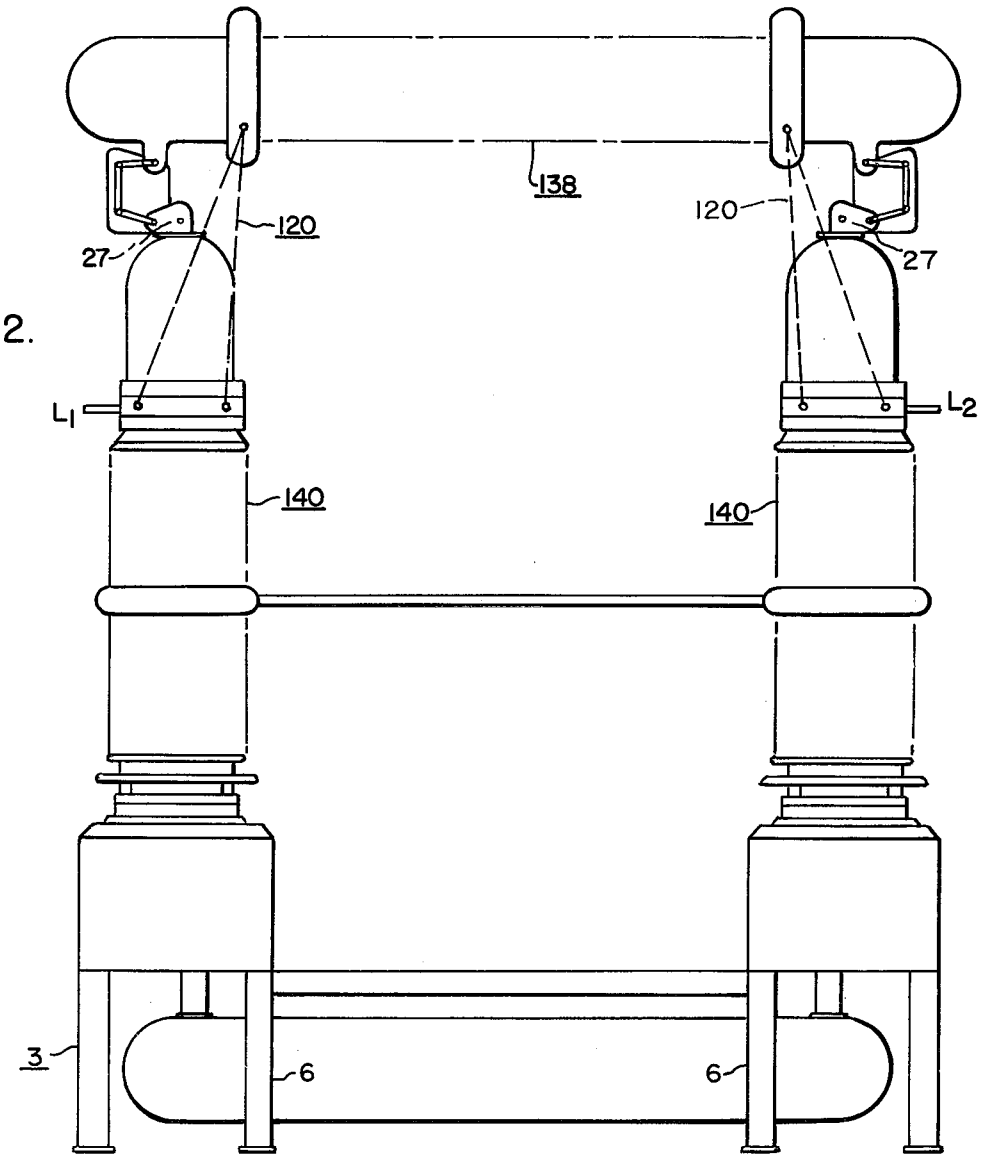
FIG. 12 illustrates still a further modification of the invention involving a pair of vertically-disposed spaced interrupting assemblages supported upon individual supporting insulating columns, with the resistor assemblage horizontally arrange and bridging the two spaced upstanding columns, and the latter provided with a "puffer-type" resistor current-interrupter unit; and, FIG. 13 illustrates yet another modification of the present invention utilizing only a single vertical resistor assemblage, and only a single main power-interrupting break, with the operators connected together, the contact structure being illustrated in the closed-circuit position.
Figure 13:
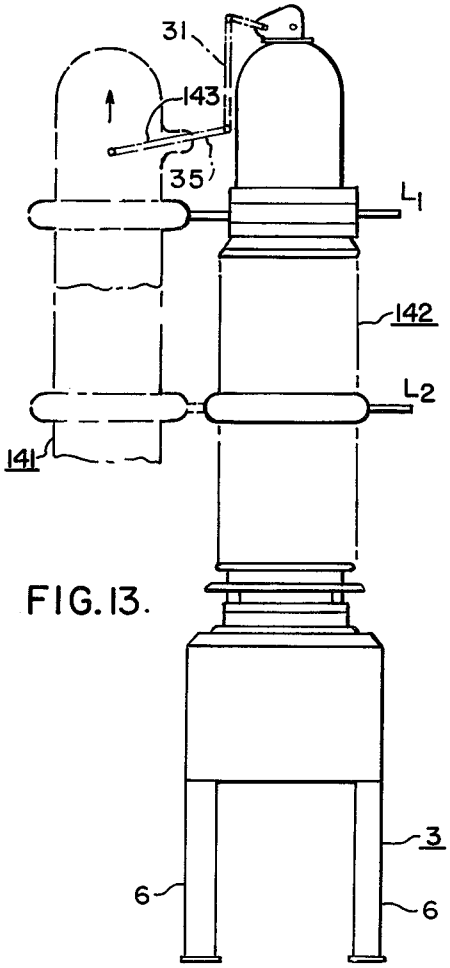

Although FIGS. 1–7 illustrate one embodiment 1 of this invention with a pair of pairs of resistors 100 and resistor interrupting contacts 73, 85 mounted in an assembly 17 across the top of the breaker 1 having a main interrupter 26 in each arm 4, 30, it is intended that the invention cover similar embodiments that would occur to one skilled in the art, such as a resistor assembly 138, mounted horizontally, so as to bridge two vertical main interrupter columns 140 (FIG. 12), or a single resistor assembly 141 paralleling a single upstanding interrupter column 142 mounted vertically, as illustrated in FIG. 13, or horizontally, or at any other convenient angle, as desired.

FIG. 13, as mentioned, illustrates such an arrangement in which the mechanical linkage 143 between a single interrupter column 142 and a single shunting resistor column 141 provides the desired sequence of operation. A pair of vertical main interrupter columns 140, bridged by a horizontal resistor assembly 138, is shown in FIG. 12.

From the foregoing description, it will be apparent that there has been provided an improved high-power high-voltage circuit-interrupter 1, in which a separate shunting resistor assemblage 17, 138, 141 is used to advantage, and in the right sequence of contact opening, to improve the interrupting rating of the circuit-breaker 1.

Although there has been illustrated and described specific structures, it is to be clearly understood that the same were merely for the purpose of illustration, and that changes and modifications may readily be made therein by those skilled in the art, without departing from the spirit and scope of the invention.

I claim:

1. A dual-pressure gas-blast type of high-power circuit-interrupter including a main-power high-voltage interrupter assemblage having a pair of separable power contacts, a high-voltage piston operator (10) for effecting opening and closing movements of said separable power contacts, an electrically-shunting puffer-type resistance interrupting unit disposed at high-voltage and electrically shunting said main-power interrupting assemblage, said shunting puffer-type resistor unit at high voltage including a pair of separable resistor contacts and an electrically serially-related resistance element, and direct connecting linkage means directly connected to said high-voltage piston operator (10) for causing the opening of the separable resistance contacts following the prior separation of the main power-interrupting contacts in the main-power interrupting assemblage.

2. The combination of claim 1, wherein one gas is utilized as the arc-extinguishing gas in the main-power interrupting assemblage, and a different gas is utilized as the arc-extinguishing gas in the puffer-type resistor assemblage.

3. The combination in a high-power circuit-interrupter of the dual-pressure type of a generally V-shaped power interrupting assemblage comprising a pair of spaced leg portions (4,30), each of said leg portions (4,30) comprising at least a pair of separable power-interrupting contacts, compressed-gas means including a high-voltage piston operator (10) for effecting the extinction of the arc drawn at each of said power-interrupting contacts, and an electrically-bridging puffer-type resistor assemblage disposed at high voltage and electrically bridging the upper high-voltage ends of the two leg portions (4,30) and having its high-voltage mechanical operator directly mechanically connected to the high-voltage piston operator (10) of each of said leg portions (4,30) to effect opening of the high-voltage resistor assemblage subsequent in point of time to the previous opening of said power interrupting assemblage.

4. The combination in a high-power compressed-gas circuit-interrupter of a pair of spaced dual-pressure power-interrupting assemblages, means for electrically connecting said dual-pressure power-interrupting assemblages in an electrical circuit, at least one of said power interrupting assemblages having a high-voltage piston operator (10) for effecting opening and closing of said one power interrupting assemblage, an electrically-shunting resistor assemblage disposed at high voltage and electrically shunting the ends of said spaced dual-pressure power-interrupting assemblages, said high-voltage electrically-shunting resistor assemblage including a resistor and serially-connected separable resistor contacts, high-voltage puffer means connected to said separable resistor contacts for providing a blast of gas at said separable resistor contacts, and a direct mechanical linkage between said high-voltage piston operator (10) and said high-voltage resistor contacts for effecting later opening of said high-voltage resistor contacts after opening of said one power interrupting assemblage.

5. The combination according to claim 4, wherein one gas is utilized at the power-interrupting assemblage, and a different gas is utilized at the resistor-shunting assemblage.

6. The combination in a high-power compressed-gas circuit-interrupter assemblage of a pair of spaced leg portions (4), a separable pair of power-interrupting contacts disposed within each leg portion (4), a mechanical operator (7) disposed at the upper end of each of said leg portions (4), a shunting puffer-type resistor assemblage including a pair of puffer separable resistor contacts and a serially-related resistance element, operating means for effecting the separation of said resistor contacts, and means mechanically interconnecting the operator for the resistor contacts with the operator (7) for the main-power contacts disposed at the upper ends of said leg portions (4).

7. In combination, a main power-interrupting assemblage including a pair of power-interrupting separable contacts, means for effecting a flow of compressed gas between said separable power-interrupting contacts to effect arc extinction therebetween, an electrically-shunting puffer-type resistor assemblage electrically paralleling the separable power-interrupter contacts, means utilizing one gas in the power-interrupting assemblage, and means utilizing a different gas in the shunting resistor assemblage.

8. In combination, an upstanding power-interrupting assemblage, separable power contacts disposed within said power-interrupting assemblage, operating means for effecting the separation of said separable power-contacts, an electrically-parallel shunting resistance assemblage, said resistance assemblage including a pair of separable resistor contacts and a piston-and-operating-cylinder arrangement for effecting gas-flow at said separable resistor contacts, operating means for said piston member, operating means for the main-power interrupter assemblage, and means mechanically directly interconnecting the two operating means for the power-interrupting assemblage and the piston-resistor assemblage, so that actuation of the operator for the main-power interrupting assemblage will additionally cause direct operating motion of the piston-resistor interrupting assemblage.

9. The combination according to claim 8, wherein separate gas chambers are utilized for each of the assemblages so that a separate gas may be utilized in each of the interrupters.

10. The combination according to claim 8, wherein contact-overlap means are provided at the separable resistance contacts to ensure that they will open subsequent to the opening of the main-power interrupting breaks.

11. In combination, a generally V-shaped power-interrupting assemblage comprising a pair of slanting leg portions (4), each of said leg portions (4) including at least one pair of separable power-interrupting contacts, compressed-gas means for effecting a gas-blast at said separable power-interrupting contacts, a bridging resistor assemblage including at least one or more piston-type resistor units having a resistor element electrically in series therewith, and means for sequentially opening the separable resistor contacts at a point in time subsequent to the opening of the main-power interrupting contacts within each of the leg portions (4).

12. The combination according to claim 11, wherein separate gas chambers are utilized at the leg portions (4), and at the resistor assemblage, so that different gases may be utilized, when desired.

13. In combination, an upstanding dual pressure power-interrupting assemblage, separable main contacts, piston operating means for effecting the separation of said separable main contacts, a resistor assemblage electrically shunting said power-interrupting assemblage, a piston-and-cylinder puffer arrangement for providing a gas flow at said separable resistor contacts, crank-arm means for interrelating operating motion of the piston operating means with operation of the movable resistance contact whereby the operating mechanism for the two interrupting assemblages may be correlated.

14. The combination according to claim 13, wherein separate gas chambers are provided for each of the interrupting chambers so that a separate gas may be utilized, when desired, for the two interrupting chambers.

15. In combination, a dual-pressure power-interrupting assembly including a pair of separable power-interrupting contacts, high-voltage resistive-shunting means including a resistance and a pair of separable resistance contacts, said high-voltage resistance contacts including movable resistance contact-fingers cooperable with a relatively-stationary rod-shaped resistance contact, high-voltage piston operating means (10) for effecting the actuation of the power-interrupting contacts, a direct mechanical linkage between the separable high-voltage resistance contacts and said high-voltage piston operating means (10), and the finger-contact overlap distance "D" of the high-voltage resistance contacts being such as to ensure separation of the high-voltage resistance contacts at a point in time subsequent to the separation of the main power interrupting contacts.

16. The combination according to claim 15, wherein separate gas chambers are provided about each of the interrupting units, so that different gases may be utilized, if desired.

17. In combination, an arc-extinguishing assemblage of the dual-pressure type including separable power contacts, high-voltage piston operating means (10) for actuating said separable contacts to the open and closed-circuit positions, said high-voltage piston operating means (10) including an operating rod (41), high-voltage crank means (12) connected to said operating rod (41) and capable of rotative movement, means defining a high-voltage puffer-type resistor interrupting unit including a pair of separable resistance contacts and a serially-related resistance element, high-voltage crank-means (95) for effecting the separating motion of the high-voltage resistor contacts, and high-voltage floating link means (31) interconnecting the two high-voltage crank-arm means.

18. The combination according to claim 17, wherein the power-interrupting assemblage includes a casing means which is separate from the casing means for the resistor-interrupting unit.

19. In combination, means defining an insulating casing, means supporting a relatively-fixed piston structure within said insulating casing, movable means including an insulating movable flow-guide, a movable operating cylinder and a movable finger-type contact finger-type contact structure slidable over said relatively-fixed piston structure to compress gas therebetween, means providing a relatively-fixed rod-shaped contact enterable within an orifice opening provided in said movable gas-flow guide for blocking the orifice opening in the closed-circuit position of the device, operating means for effecting slidable motion of said movable operating cylinder over said relatively-fixed piston structure carrying therewith the finger-type movable contact structure and the movable gas-flow guide, said gas-flow guide including a pair of spaced orifice members having aligned openings therein through which enters the fixed rod-shaped stationary contact in the closed-circuit position of the device, the movable contact fingers constituting the movable contact being shielded by the inner of said spaced orifice members so that the established arc is drawn through both of the spaced orifice openings of said pair of spaced orifice members, whereby during the opening operation of the device the opening movement of the movable flow-guide causes sequential opening of first the inner orifice member (129) and subsequently, in point of time, uncovering of the outer orifice member (130), so that the arc is established within both orifice openings and the radial inflow of said compressed gas occurring between the spaced orifice openings to result in axial venting of the gas flow in opposite directions through both orifice openings for effective arc-extinguishing action.

20. The combination according to claim 19, wherein the movable contact fingers make engagement with the outer sides of the relatively-fixed rod-shaped stationary contact, whereby a desired contact-overlap distance "D" is provided to thereby delay the establishment of an arc between the movable contact structure and the relatively-fixed rod-shaped stationary contact for a desired precompression of the gas during the blocking action of the relatively-fixed rod-shaped stationary contact.

21. The combination according to claim 19, wherein the operating means includes an operating rod slidable through an opening provided in the relatively-fixed piston structure, and having fixedly attached thereto adjacent one end thereof said movable contact fingers and said movable gas-flow guide.

* * * * *